US010118722B2

(12) United States Patent
Serjeantson et al.

(10) Patent No.: US 10,118,722 B2
(45) Date of Patent: Nov. 6, 2018

(54) PACKAGE SORTING, PACKING AND RE-WEIGHING SYSTEM

(71) Applicant: Dicom Transportation Group, Dorval (CA)

(72) Inventors: Kirk Serjeantson, Dorval (CA); Mathew Dunlop, Dorval (CA); Patrick Beaudoin, Dorval (CA); Jean-Francois Busque, Dorval (CA); Pierre David Labre, Dorval (CA); Jean-Luc Pampin, Dorval (CA); Olga Aouslender, Dorval (CA)

(73) Assignee: Dicom Transportation Group, Dorval (CA)

( * ) Notice: Subject to any disclaimer, the term of this patent is extended or adjusted under 35 U.S.C. 154(b) by 0 days.

(21) Appl. No.: 15/187,540

(22) Filed: Jun. 20, 2016

(65) Prior Publication Data

US 2016/0368643 A1 Dec. 22, 2016

Related U.S. Application Data

(60) Provisional application No. 62/181,507, filed on Jun. 18, 2015.

(51) Int. Cl.

| | |
|---|---|
| ***G06F 7/00*** | (2006.01) |
| ***B65B 57/12*** | (2006.01) |
| ***B65B 57/18*** | (2006.01) |
| ***B65B 57/04*** | (2006.01) |
| ***B65B 57/06*** | (2006.01) |
| ***B65B 57/14*** | (2006.01) |
| ***B65B 1/32*** | (2006.01) |

(52) U.S. Cl.

CPC ..... *B65B 57/12* (2013.01); *B65B 1/32* (2013.01); *B65B 57/04* (2013.01); *B65B 57/06* (2013.01); *B65B 57/14* (2013.01); *B65B 57/18* (2013.01)

(58) Field of Classification Search

None

See application file for complete search history.

(56) References Cited

U.S. PATENT DOCUMENTS

| | | | | |
|---|---|---|---|---|
| 8,560,461 | B1 * | 10/2013 | Tian | G06Q 10/087 705/332 |
| 9,230,233 | B1 * | 1/2016 | Sundaresan | G06Q 10/0832 |
| 9,315,344 | B1 * | 4/2016 | Lehmann | G06Q 10/08 |
| 2015/0307278 | A1 * | 10/2015 | Wickham | G05B 15/02 700/216 |

* cited by examiner

*Primary Examiner* — Yolanda R Cumbess

(74) *Attorney, Agent, or Firm* — Duane Morris LLP

(57) ABSTRACT

A package sorting system is described that can be used to efficiently sort and pack Ropak containers for transporting packages from a sorting facility to a destination facility. The package sorting system can determine a particular Ropak container to place the package in as well as determine if the package was placed in the current Ropak container.

17 Claims, 4 Drawing Sheets

PACKAGE SORTING, PACKING AND RE-WEIGHING SYSTEM

CROSS-REFERENCE TO RELATED APPLICATIONS

The current disclosure claims priority to U.S. Provisional application 62/181,507, filed Jun. 18, 2015, the entire contents of which are incorporated herein by reference for all purposes.

TECHNICAL FIELD

The present disclosure relates to sorting packages and in particular to sorting and packaging the packages into containers incorporating re-weighing of the packages.

BACKGROUND

The shipping industry the transportation of packages can require redirection between plastic bulk containers for sorting packages to destination. Ropak™ containers is a proprietary container used to load packages into to protect parcels from getting damaged during the shipping process. Each Ropak can hold a number of packages which are protected in a durable container. Using Ropak containers can be used to load small parcel freight reducing requirement to transport each parcel separately. This process reduces claims against damage packages.

FIG. 1 depicts a typical sorting process used at sorting facilities that transport packages to the destination area in Ropak containers. According to the method 100, parcels are moved to a Ropak packing area (102), the terminal ID on a way bill is verified (104) and it is determined if the terminal ID is the same as the Ropak container's destination (106). If the terminal ID does not match the Ropak (No at 106), the parcel is push on the conveyor to a subsequent clerk (108). If the destination match (yes at 106) the parcel is removed from the conveyor (110) and it is determined if there is space in the Ropak (112). If there is space (yes at 112) the parcel is placed in the Ropak (114). If there is no space (no at 112), the parcel is set aside (116), an empty Ropak is mounted (118) and the Ropak's destination indicated with a sheet of paper placed on the Ropak (120) and packing continues. Some issues with the current process are the packages can get sorted to the incorrect Ropak (putting the Toronto Ropak into the London Ropak). This is called a missort. Other issues include Ropaks not being loaded efficiently causing wasted space in the Ropak.

None of the prior attempts consider the Ropak container nor do they take into account the optimal use of space. Accordingly, systems and methods that enable improved efficiency of transport containers in the parcel shipping process remains highly desirable.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
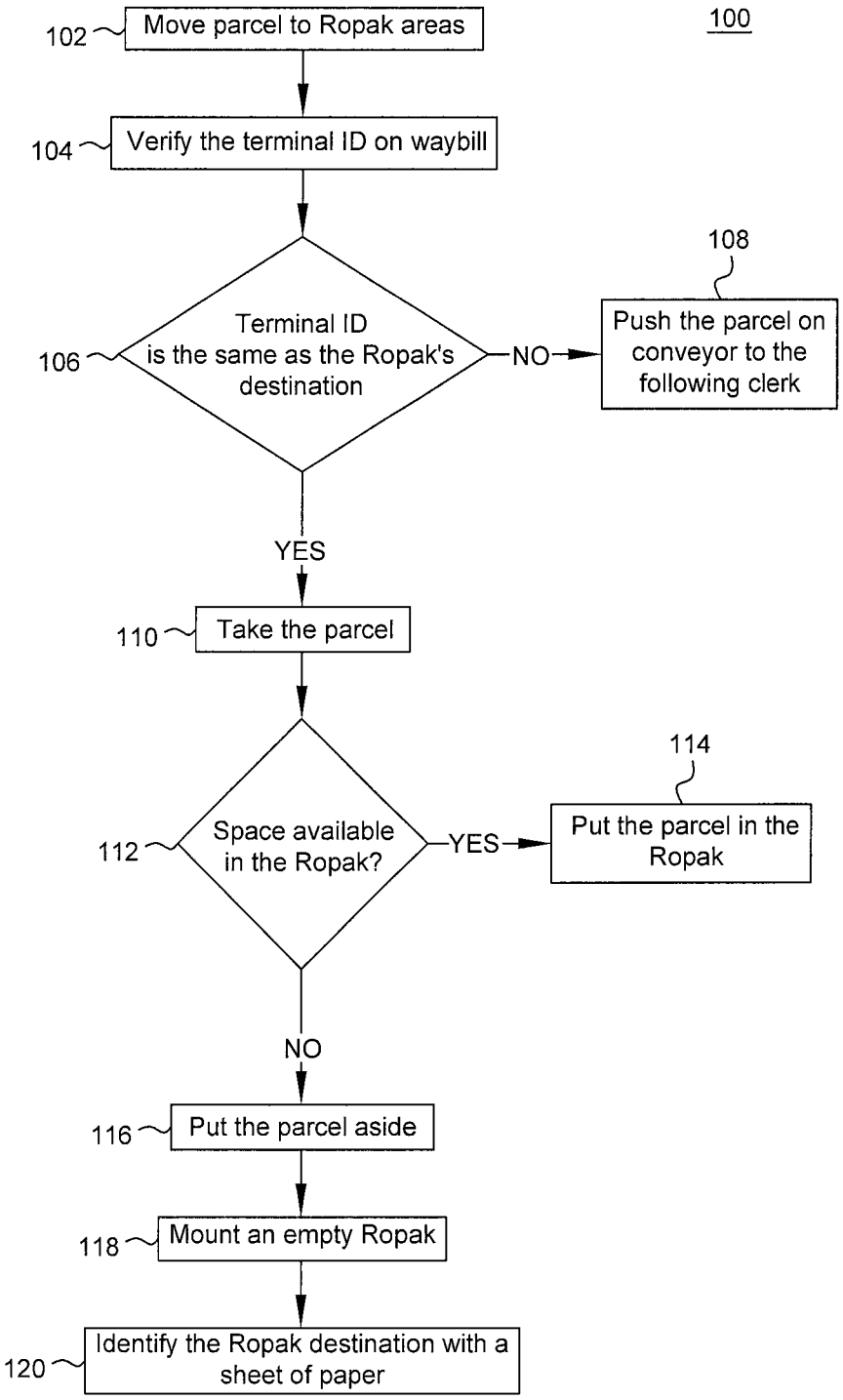
FIG. 1 shows an existing method of Ropak package sorting.

In accordance with the present disclosure there is provided a method of sorting packages at a sorting facility receiving a plurality of packages en-route from a plurality of sender locations to a plurality of destination locations, the method comprising: determining package information associated with one of the plurality of packages, the package information including physical information and destination information for the package; determining a package container to place the package in based on the determined package information; and determining based on the package information and weight information received from a scale the package container is sitting on that the package has been placed in the determined package container.

In accordance with a further embodiment, the method further comprises providing an audio and/or visual cue to a sorter indicating the determined package container to place the package in from among a plurality of package containers at a sorting location.

In accordance with a further embodiment, the method further comprises providing a second audio and/or visual cue to the sorter indicating that the package was not placed in the determined package container.

In accordance with a further embodiment, the method further comprises providing a separate audio and/or visual cue to a second sorter indicating a determined package container from among the plurality of containers at the sorting location to place a package from the plurality of packages in.

In accordance with a further embodiment, the method further comprises determining a placement location within the determined package container based on the physical information of the package; and providing a visual indication of the determined placement location.

In accordance with a further embodiment, the method further comprises receiving an image of the package container including the placement of the package within the package container; comparing the determined placement location to the placement of the package within the package container; and providing an audio/video indication of correct or incorrect placement of the package.

In a further embodiment of the method, determining the placement location within the determined package container comprises: determining placement locations for a plurality of accumulated packages to be placed within the package container.

In a further embodiment of the method, the plurality of accumulated packages comprise packages of the plurality of packages that have been processed to determine package information but have not been placed into the package container.

In accordance with a further embodiment, the method further comprises receiving a unique package identifier associated with the package to be placed in the determined package container; and storing the received unique package identifier in association with a unique identifier of the determined package container.

In accordance with a further embodiment, the method further comprises determining that the package container is full; and providing an audio and/or visual indication that the package container is full.

In accordance with a further embodiment, the method further comprises determining that a new package container has been placed on the scale; and receiving a unique identifier associated with the new package container placed on the scale.

In a further embodiment of the method, determining the package container is full comprises one or more of: determining that the package container is full based on a weight of the package container received from the scale; and determining that the package container is full based on available packing locations of the package container based on packages that have been placed within the package container.

In accordance with a further embodiment, the method further comprises receiving the unique identifier of the determined package container immediately before or immediately after the unique package identifier is received.

In accordance with a further embodiment, the method further comprises capturing and storing an image of the package within the determined package container.

In accordance with a further embodiment, the method further comprises receiving at least a portion of the package information including the destination information for each of the plurality of packages received for shipping in a given time period; determining a destination areas required to deliver packages to the destination information of the plurality of packages received in the given time period; estimating a number of package containers required for each of the determined destination areas; and estimating a number of sorters required for sorting the plurality of packages into the package containers at a plurality of sorting locations.

In accordance with a further embodiment, the method further comprises determining destination, areas to be sorted at the plurality of sorting locations based on the sorting locations location at a conveyor system of the plurality of packages and on a number of packages having destination information within the destination area, wherein destination areas associated with more packages are located further downstream on the conveyor system.

In accordance with, the present disclosure there is further provided a system for sorting packages at a sorting facility receiving a plurality of packages en-route from a plurality of sender locations to a plurality of destination locations, the system comprising: a conveyor for moving the plurality of packages between a plurality of sorting locations; a plurality of scales at each of the plurality of sorting locations, each of the plurality of scales for receiving a package container associated with a destination area; and a computer system in communication with each of the plurality of scales a configured for: determining package information associated with one of the plurality of packages, the package information including physical information and destination information for the package; determining a package container to place the package in based on the determined package information, and determining based on the package information and weight information received from a scale the package container is sitting on that the package has been placed in the determined package container.

In accordance with the present disclosure there is further provided a computer system for use in sorting packages at a sorting facility receiving a plurality of packages en-route from a plurality of sender locations to a plurality of destination locations, the computer system comprising: a processor for executing instructions; an interface for communicating with a plurality of scales; and a memory for storing instruction, which when executed by the processor configure the computer system to: determine package information, associated with one of the plurality of packages, the package information including physical information and destination information for the package; determine a package container to place the package in based on the determined, package information; and determining based on the package information and weight information received from a scale the package container is sitting on that the package has been placed in the determined package container.

Embodiments are described below, by way of example only, with reference to FIGS. 1-4.

The disclosed technology solves several operational issues and provides optimal Ropak utilization as well as obtaining re-weighing on the packages as they are packed into the Ropak. Further the system allows obtaining scanning on the packages as they are placed in the Ropak container and providing tracking of the containerization of package to Ropak and to trailer, to linehaul and to terminal for better freight visibility. The scanning of packages and re-weighing on the packages placed into the Ropak container can help eliminate or reduce missorted freight packages. The system described herein uses stationary scales which eliminate in-motion re-weighing from the package induction, which can result in savings due to eliminating costly in-motion weighing systems. The system further can alert forklift operators when a Ropak container is full and ready to be moved from the sorting/packing location to a vehicle for transportation to the appropriate destination area and subsequent delivery of the individual packages to their destinations within the delivery area. The system may further use package information that will be processed in the following day, or other time period, in order to estimate the number of sorting/packing locations for efficiently sorting the incoming packages to the different destination areas, as welt as estimating a number of Ropaks that will be required for each sorting location and the number of sorters for each sorting location, which can help in developing optimal staffing plans for the sorting facility and in turn increase the terminal's efficiency, such as improving Ropak container utilization and capacity of the sorting terminal.

As described further below, the sorting system leverages Leveraging dimensional data of the packages, which may be received from upstream processes such as a cubing machine, to assist the Ropak sorter to ensure optimal usage of space. A floor scale underneath each Ropak is used as an input device to know when a package is placed in a specific Ropak. A visual and/or audible indicator may be used to direct the sorter to put the package in the correct Ropak and advise forklift driver when the Ropak is full. Incoming data from shippers, and on road drivers may be used to feed the system to understand the number of staff required in what location to successfully process the expected package volume through the system. Information from barcodes and sensors is used to determine what package has been placed in what Ropak for downstream analytics on processing.

This solution leverages cubing or dimensional data from upstream systems to better load the Ropak to avoid wasted space. Also, because the loading of Ropaks is a manual process, that is a person must place the package into the Ropak, incoming data from shipping system's and drivers can be used to help staff the manual sort process. Knowing the incoming volume and timing of receipt of volume can help managers know how many people they need to sort per Ropak or destination area, will help them know how many Ropaks they need to contain all the volume by destination and will allow the managers to know approximately how many trailers are required to transport the Ropaks to the destination area This process may also eliminate, or at least reduce, the number of missorts (pieces placed in the incorrect Ropak) as well as provide the end customer with better visibility on their packages.

Customer shipping systems send in data on inbound package volumes. This is confirmed by pickup drivers which may additionally account for any packages not processed through the shipping system.

Software assesses pieces per destination and calculates an estimate on the number of Ropaks required per sort destination for the night, or other time period when shipments are processed. System also assesses number of required sort locations as well as how many sorters are required to manage the volume, and based on destination and volume how many Ropaks each sorter needs to be assigned to be effective. For example, based on package volume, it may be necessary to have two sort locations dedicated to packing Ropaks for one destination area, while a single sort location packs Ropaks for two different destination areas. The package volume estimates may be used to help managers build the appropriate setup for the evenings sort activities. Using the incoming data from the shipping systems and mobile devices the Ropak, sorting system can forecast the staffing requirement and Ropak setup. Leveraging a standard productivity measure for how many pieces can be sorted by a sorter coupled with the incoming volume, the system can determine how many sorters per sort location is needed. For example we known low volume lanes can be coupled together to be managed by a single person. Higher volume sorts could be assigned to a number of individuals, either at the same sort location and/or different sort locations based on the calculated and projected productivity.

Figure 2:
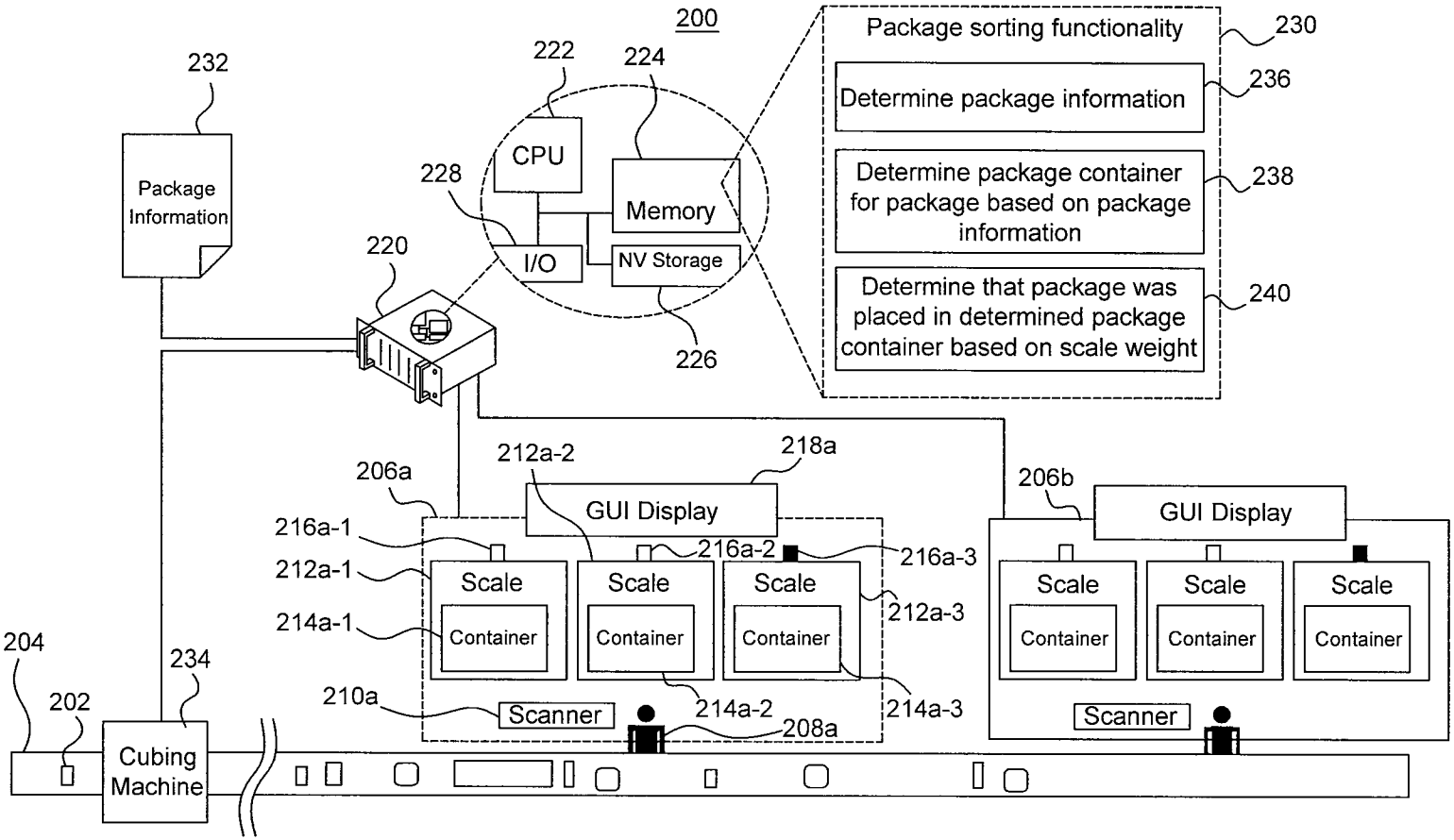
FIG. 2 shows a system for Ropak package sorting in accordance with the present disclosure.

FIG. 2 shows a system for Ropak package sorting in accordance with the present disclosure. The system 200 allows a number of packages 202 to be processed and packaged for transport to a destination area terminal. The destination area may be for example associated with a city or region. The packages 202 are received at the sorting facility and placed on a conveyor 204 or other transport system for moving the packages through the sorting facility. One or more sorting locations 206*a*, 206*b* (referred to collectively as sorting locations 206) may be used to place the packages into appropriate package containers, which are Ropak containers. The Ropak container provide a reusable and simple container that can be easily collapsed for easy transport of the empty containers. Each of the sorting locations 206 may be located sequentially along the conveyor 204 so that packages pass from one sorting location 206*a* to the other 206*b*. Although two sorting locations are depicted, it is possible for the number of sorting locations to be configured based on the packages being processed.

Each of the sorting locations 206 are similar, and as such only the detailed operation with regard to a single sorting location 206*a* is, described further. Although each of the sorting locations 206 are similar, numbers of containers and sorters at each of the sorting locations 206 may vary.

The sorting location 206*a* comprises at least one sorter 208*a* that is responsible for taking packages 202 off of the conveyor 204 and placing the package in a Ropak package container. The sorter 208*a* uses a scanner, which may be a barcode scanner, RFID scanner, etc. to scan a package. The sorter 208*a* may be responsible for sorting packages destined to a plurality of different destination areas or for the same destination area. However, typically a sorter is capable of sorting packages into a plurality of different Ropak package containers at the same time Each sorting locations comprises a number of stationary scales 212*a*-1, 212*a*-2, 212*a*-3 (referred to collectively as stationary scales 212), with each of the stationary, scales supporting, and weighing, an associated Ropak package container 214*a*-1, 214*a*-2, 214*a*-3. (referred to collectively as Ropak containers 214). Further, each of the Ropak containers 214, or the scales 212, is associated with at least one audio/visual indicator 216*a*-1, 216*a*-2, 216*a*-3 (referred to collectively as AV indicators 216). The AV indicators 216 provide an indication to the sorter which one of the Ropak containers 214 the scanned package should be placed in. As indicated in FIG. 1, AV indicator 216*a*-3 is lit indicating that the scanned package should be placed into the Ropak container 214*a*-3. Accordingly, as the sorter scans packages, the package is placed in the correct Ropak container. The system verifies that the package was placed in the correct container based on the weight information proceeded from the scale the container is sitting on. If the system determines that the package was placed in the incorrect container, the system may provide an audio and/or video indication, possibly using the AV indicators 216, that the package placement was incorrect.

Additionally, each sorting location 206*a* may be provided with a GUI display 218*a* that provides useful information to the sorter 208*a*. Although indicated as a single GUI display 218*a*, it is possible for each one of the scales 216 to be associated with a GUI display. The GUI display 218*a* can provide an indication to the sorter where the package should be placed within the container to increase the packing efficiency of the container. The system may track packages that have been received but not yet placed and account for their subsequent packing in order to determine package placement within containers. The GUI display may provide a visual indication to the sorter on an orientation of the package and its placement location within the Ropak container. Additionally, although not depicted in FIG. 1, it is possible for an overhead camera or scanner to provide an image indicative of the actual placement of the package, which may in turn be processed to determine whether or not the package was placed correctly, and possibly provide information on free space available for packing in the Ropak container. If the placement of the package is incorrect, the system may provide feedback on the correct placement.

As depicted, a computer system 220 may control the overall sorting facility. The computer system 220 may comprise a central processing unit 222, coupled to a memory unit 224 for storing instructions as well as non-volatile storage unit 226 for long term storage of instructions. An input/output interface 228 may couple a plurality of I/O devices to the computer system 220. When the instructions stored in the memory are executed, the computer system is configured to provide various package sorting functionality 230. The package sorting functionality may use package information 232 provide from one or more external sources. The package information provides information for each package including at least a destination location of the package. The package information may further include physical information such as the weight, and physical dimensions of the package. If the physical dimensions of the package are not provided in the received package information 232, a cubing machine 234 located on the conveyor belt may determine the physical dimensions, i.e. length, width, and height, and provide the information to the computer 220.

The package sorting functionality 230 determines the package information for a package (236) including the destination area the packages destination location is within, and at least the weight of the package. A package container is determined that the package should be placed within based on the determined package information (238). When a sorter scans a package, the determined package container to place the package in is indicated to the sorter and the weight from the scale the determined package container is sitting on is used to determine if the package was placed in the correct container (240). If the package was placed in the wrong package, container the missort can be communicated to the sorter and corrected.

Once the correct placement of the scanned package into the indicated Ropak container is determined using the weight of the package and the measured weight of the package container, the system can associate the scanned package with the package container, and possibly capture a confirming picture of the package in the container. Additionally, the sorting system may use the determined physical dimensions of the package to determine a packing location within, a package container to increase the space efficiency of the package container. The desired packing location may, account, for packages that have not yet been placed in container but have been input into the system for subsequent packing into a container. The desired placement may be indicated to the sorter, for example using the GUI display. Further, an image may be captured of the placed package to confirm that the package was placed in the correct location. Once the package container is full, either determined based on its maximum weight capacity being reached as determined by the associated scale, or based on their being not enough free space within the container, either determined by the computer based on further packages required to be shipped; or possibly by the sorter themselves, the system may provide a signal, possibly using the AV indicator 216*a*-1, to a forklift operator to place the container into a transport vehicle.

As each package is scanned and subsequently placed into the container by the sorter, the sorter may scan a unique identifier associated with the container so that the system can link the package to the container, which in turn can be linked to the transport vehicle used to transport the container to the destination area. Rather than scanning the container's unique ID each time a scanned package is placed into the container, the sorter may scan the unique ID when an empty container is placed on the scale, and the system can link the scanned package ID with the package container's unique ID, when the placement within the package container has been verified based on the weight of the package container.

Figure 3:
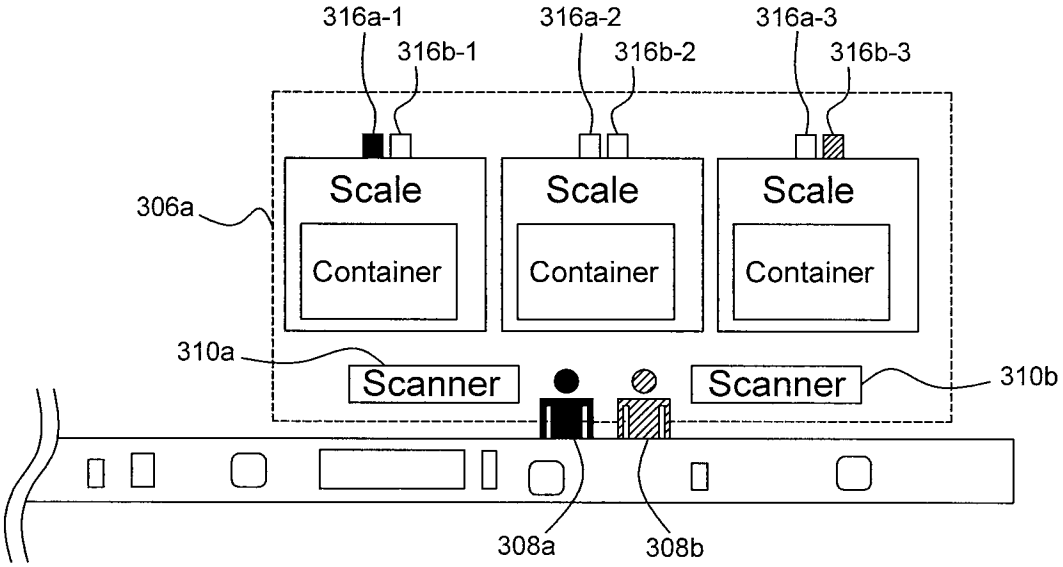
FIG. 3 shows an alternative arrangement of the system for Ropak package sorting in accordance with the present disclosure.

FIG. 3 shows an alternative arrangement of the system for Ropak package sorting in accordance with the present disclosure. The system of FIG. 3 is similar to that described above with reference to FIG. 2 however two sorters 308*a*, 308*b* are depicted as being associated with an individual sort location. The two sorters 308 may each have their own scanner 310*a*, 310*b* for scanning packages. Further, each of the container locations, or the containers themselves, are provide with at least two AV indicators 316*a*-1, 316*b*-1, 316*a*-2, 316*b*-2, 316*a*-3, 316*b*-3 with one of the indicators 316*a*-1-316*a*-3 associated with one sorter 308*a* and providing the sorter with an indication of the container to place the scanned package in. The other AV indicator 316*b*-1-316*b*-3 associated with each of the container locations may be associated with the other sorter 308*b* and provide an indication to that sorter which container the scanned package should be placed in.

Figure 4:
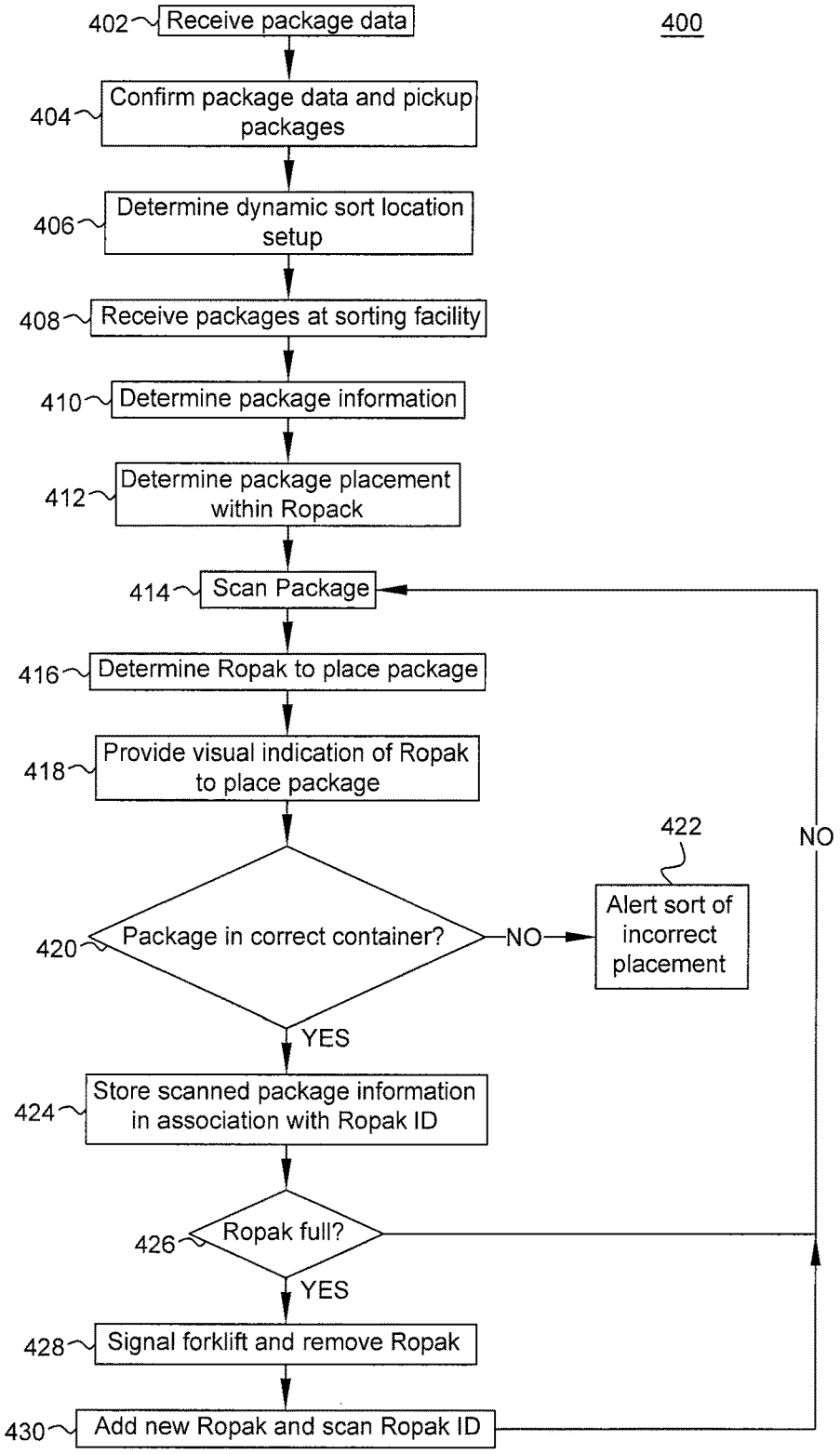
FIG. 4 shows a method of using the system for Ropak package sorting.

FIG. 4 shows a method of using the system for Ropak package sorting. The method 400 receives customer shipping systems send in data on inbound packages from customer shipping systems (402). The data may include information on the packages destination, weight and possibly dimensions. This package information may be confirmed by pickup drivers (404) as well as adding any additional packages not processed through a shipping system.

The software assesses packages, per destination and calculates the number of Ropaks required per sort destination for the night (406). The system may also determine the dynamic sort location setup (408) including a number of required sort locations, for example are two sort locations need for a particular destination due to high volume, as, well as how many sorters are required to manage the volume, and based on destination and volume how many Ropaks each sorter needs to be assigned to be effective Manager uses information to build the appropriate setup for the evenings sort activities The packages are received at the sorting facility and unloaded (410). A cubing machine or dimensional system is used to determine physical dimensions as well as identify a package order on the conveyer (412). The packages may take for example about 120 seconds to reach the Ropaks sorting location from the cubing machine. The cubing machine takes the length, width and height of each box and the order in which it reaches the sorter. The system then determines the best way to place each box into the Ropak based on the dimensions provided by the cubing machine (414). The packaging information may be based on the packages between the sorting location, i.e., where the packages are placed into the container, and the cubing machine, so for example 120 seconds worth of packages may be used in determining the ideal package placement. The package placement may be reconfigured for packages that have not yet been placed in a container.

A sorting loading the package container picks a package from the conveyor and scans the package (416). The monitor attached to the system displays the location within the Ropak and orientation required for maximum Ropak utilization (418). Using a smart barcode the system shows the user which Ropak to place the package into via visual or audible cues. The system waits for a reading from the scale associated with the Ropak container to determine if the package was placed in the correct Ropak (420). If not (No at 420), the user is alerted (422) and corrective action is taken. Once the package is in the correct container (Yes at 420) the system may store the package information in association with the container ID (424). The system calculates how many pieces have been placed in a Ropak and containerizes each piece to the Ropak to determine if the Ropak is full (426). The Ropak utilization is measured based on the dimensions of each piece that has been placed in each Ropak against the available volume within each Ropak, or based on the maximum weight of each Ropak. When a Ropak is full (Yes at 426), a forklift operator is signalled, the Ropak is removed from the scale (428) and there is a significant weight reduction from the scale. A new Ropak is added the weight increment post removal signals to the system a new Ropak has been added and the sorter may scan the ID of the new Ropak container (430). Once the new Ropak has been added, or if the Ropak is not yet full (No at 426) packaging continues.

Each element in the embodiments of the present disclosure may be implemented as hardware, software/program, or any combination thereof. Software codes, either in its entirety or a part thereof, may be stored in a computer readable medium or memory (e.g., as a ROM, for example a non-volatile memory such as flash memory, CD ROM, DVD ROM, Blu-ray™, a semiconductor ROM, USB, or a magnetic recording medium, for example a hard disk). The program may be in the form of source code, object code, a code intermediate source and object code such as partially compiled form, or in any other form.

It would be appreciated by one of ordinary skill in the art that the system and components shown in FIGS. 1-4 may include components not shown in the drawings. For simplicity and clarity of the illustration, elements in the figures are not necessarily to scale, are only schematic and are non-limiting of the elements structures. It will be apparent to persons skilled in the art that a number of variations and modifications can be made without departing from the scope of the invention as defined in the claims.

What is claimed is:

1. A method of sorting packages at a sorting facility receiving a plurality of packages en-route from a plurality of sender locations to a plurality of destination locations, the method comprising:

determining package information associated with each one of the plurality of packages, the package information including physical information and destination information for the respective package;

determining a package container from a plurality of package containers each associated with a different terminal delivery area to place each of the plurality of packages in based on the determined package information and terminal delivery area encompassing the destination information;

determining a weight of each package container when each of the plurality of packages is placed in a respective one of the plurality of package containers based on the package information and weight information received from a respective scale the package container is sitting on;

determining that one of the plurality of package containers is full based on a weight of the respective package container received from the scale or available packing locations of the respective package container based on packages that have been placed within the package container; and providing an audio and/or visual indication that the determined one of the plurality of package containers is full for the associated terminal delivery area.

2. The method of claim 1, further comprising:

providing a second audio and/or visual cue to a sorter indicating the determined package container to place the package in from among the plurality of package containers at a sorting location.

3. The method of claim 2, further comprising:

providing a third audio and/or visual cue to the sorter indicating that the package was not placed in the determined package container.

4. The method of claim 2, further comprising:

providing a separate audio and/or visual cue to a second sorter indicating a determined package container from among the plurality of containers at the sorting location to place a package from the plurality of packages in.

5. The method of claim 1, further comprising:

determining a placement location within the determined package container based on the physical information of the package; and providing a visual indication of the determined placement location.

6. The method of claim 5, further comprising:

receiving an image of the package container including placement of the package within the package container;

comparing the determined placement location to the placement of the package within the package container; and providing an audio/video indication of correct or incorrect placement of the package.

7. The method of claim 5, wherein determining the placement location within the determined package container comprises:

determining placement locations for a plurality of accumulated packages to be placed within the package container.

8. The method of claim 7, wherein the plurality of accumulated packages comprises packages of the plurality of packages that have been processed to determine package information but have not been placed into the package container.

9. The method of claim 1, further comprising:

receiving a unique package identifier associated with the package to be placed in the determined package container; and storing the received unique package identifier in association with a unique identifier of the determined package container.

10. The method of claim 9, further comprising:

receiving the unique identifier of the determined package container immediately before or immediately after the unique package identifier is received.

11. The method of claim 9, further comprising:

capturing and storing an image of the package within the determined package container.

12. The method of claim 1, further comprising:

determining that a new package container has been placed on the scale; and receiving a unique identifier associated with the new package container placed on the scale.

13. The method of claim 1, further comprising:

receiving at least a portion of the package information including the destination information for each of the plurality of packages received for shipping in a given time period;

determining destination areas required to deliver packages to the destination information of the plurality of packages received in the given time period;

estimating a number of package containers required for each of the determined destination areas; and estimating a number of sorters required for sorting the plurality of packages into the package containers at a plurality of sorting locations.

14. The method of claim 13, further comprising:

determining destination areas to be sorted at the plurality of sorting locations based at a conveyor system of the plurality of packages and on a number of packages having destination information within the destination area, wherein destination areas associated with more packages are located further downstream on the conveyor system.

15. The method of claim 1 wherein the package container is a Ropak container.

16. A system for sorting packages at a sorting facility receiving a plurality of packages en-route from a plurality of sender locations to a plurality of destination locations, the system comprising:

a conveyor for moving the plurality of packages between a plurality of sorting locations;

a plurality of scales at each of the plurality of sorting locations, each of the plurality of scales for receiving a package container each associated with a terminal delivery area; and a computer system in communication with each of the plurality of scales a configured for:

determining package information associated with each one of the plurality of packages, the package information including physical information and destination information for the package;

determining a package container from the plurality of package containers associated with a different terminal delivery area to place each of the plurality of packages based on the determined package information and terminal delivery area encompassing the destination information;

determining a weight of each package container when each of the plurality of packages is placed in a respective one of the plurality of package containers based on the package information and weight information received from a respective scale the package container is sitting on;

determining that one of the plurality of package containers is full based on a weight of the respective package container received from the scale or available packing locations of the respective package container based on packages that have been placed within the package container; and providing an audio and/or visual indication that the determined one of the plurality of package containers is full for the associated terminal delivery area.

17. A computer system for use in sorting packages at a sorting facility receiving a plurality of packages en-route from a plurality of sender locations to a plurality of destination locations, the computer system comprising:

a processor for executing instructions;

an interface for communicating with a plurality of scales; and a memory for storing instruction, which when executed by the processor configure the computer system to:

determine package information associated with each one of the plurality of packages, the package information including physical information and destination information for the respective package;

determine a package container from a plurality of package containers each associated with a different terminal delivery area to place each of the plurality of packages in based on the determined package information and terminal delivery area encompassing the destination information;

determining a weight of each package container when each of the plurality of packages is placed in a respective one of the plurality of package containers based on the package information and weight information received from a scale the package container is sitting on;

determining that one of the plurality of package containers is full based on a weight of the respective package container received from the scale or available packing locations of the respective package container based on packages that have been placed within the package container; and providing an audio and/or visual indication that the determined one of the plurality of package containers is full for the associated terminal delivery area.

* * * * *